US008455851B2

(12) United States Patent
Tanaka et al.

(10) Patent No.: US 8,455,851 B2
(45) Date of Patent: Jun. 4, 2013

(54) OPTICAL SENSOR AND IMAGE FORMING APPARATUS

(75) Inventors: Kayoko Tanaka, Tokyo (JP); Kohta Fujimori, Kanagawa (JP); Shin Hasegawa, Kanagawa (JP); Yoshiaki Miyashita, Tokyo (JP); Nobutaka Takeuchi, Kanagawa (JP); Akira Yoshida, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 369 days.

(21) Appl. No.: 12/856,114

(22) Filed: Aug. 13, 2010

(65) Prior Publication Data

US 2011/0052239 A1 Mar. 3, 2011

(30) Foreign Application Priority Data

Aug. 27, 2009 (JP) ..... 2009-197079

(51) Int. Cl.
*G01N 21/55* (2006.01)
*G03G 15/00* (2006.01)

(52) U.S. Cl.
USPC ..... 250/559.16; 250/559.01; 399/74; 399/49

(58) Field of Classification Search
USPC ..... 250/214 R, 214 C, 559.01, 559.06, 250/559.1, 559.16, 559.18; 399/38, 49, 74, 399/220, 221; 356/429, 600
See application file for complete search history.

(56) References Cited

U.S. PATENT DOCUMENTS

| | | | | |
|---|---|---|---|---|
| 5,182,600 | A | 1/1993 | Hasegawa et al. | |
| 5,198,861 | A | 3/1993 | Hasegawa et al. | |
| 5,327,196 | A | 7/1994 | Kato et al. | |
| 5,387,965 | A | 2/1995 | Hasegawa et al. | |
| 5,630,195 | A | 5/1997 | Sawayama et al. | |
| 5,761,570 | A | 6/1998 | Sawayama et al. | |
| 5,857,131 | A | 1/1999 | Hasegawa | |
| 5,860,038 | A | 1/1999 | Kato et al. | |
| 6,055,386 | A | 4/2000 | Kato et al. | |
| 6,160,569 | A | 12/2000 | Fujimori et al. | |
| 6,496,677 | B2 | 12/2002 | Fujimori | |
| 7,228,081 | B2 | 6/2007 | Hasegawa et al. | |
| 7,251,420 | B2 | 7/2007 | Fujimori et al. | |
| 7,655,936 | B2 | 2/2010 | Sawayama et al. | |
| 2004/0141764 | A1 * | 7/2004 | Runkowske et al. | 399/38 |
| 2004/0251435 | A1 | 12/2004 | Sawayama et al. | |

(Continued)

FOREIGN PATENT DOCUMENTS

| | | |
|---|---|---|
| JP | 2005-24459 | 1/2005 |
| JP | 2006-39389 | 2/2006 |

OTHER PUBLICATIONS

Extended European Search Report issued Dec. 17, 2010, in European Patent Application No. 10173252.7.

*Primary Examiner* — Kevin Pyo
(74) *Attorney, Agent, or Firm* — Oblon, Spivak, McClelland, Maier & Neustadt, L.L.P.

(57) ABSTRACT

An optical sensor includes: a light-emitting unit; a light-receiving unit that receives light radiated from the light-emitting unit and reflected from a detection target and that outputs an output value in response to the light received; and a correcting unit that corrects the output value of the light-receiving unit when receiving the light reflected from the detection target based on the output value of the light-receiving unit obtained by irradiating a detection area of the optical sensor with light without any light reflective objects being present in the detection area.

15 Claims, 10 Drawing Sheets

U.S. PATENT DOCUMENTS

2006/0274628 A1* 12/2006 Tanaka et al. ..... 369/100
2008/0056744 A1 3/2008 Takahashi
2008/0145089 A1 6/2008 Takahashi
2008/0292360 A1 11/2008 Hirai

* cited by examiner

OPTICAL SENSOR AND IMAGE FORMING APPARATUS

CROSS-REFERENCE TO RELATED APPLICATIONS

The present application claims priority to and incorporates by reference the entire contents of Japanese Patent Application No. 2009-197079 filed in Japan on Aug. 27, 2009.

BACKGROUND OF THE INVENTION

1. Field of the Invention

The present invention relates to an optical sensor and an image forming apparatus.

2. Description of the Related Art

Conventionally, an image forming apparatus that performs image quality adjustment control such as process control based on specific conditions, e.g., immediately after the power is turned on or the accumulated number of printouts reaching a specific number, is known. In the image quality adjustment control, for example, a light-emitting element that is a light-emitting unit for an optical sensor emits light so that the emitted light is reflected on a bare surface portion (a portion where toner is not adhered) of an intermediate transfer belt as a detection target, and a light-receiving element that is a light-receiving unit for the optical sensor receives the light reflected and outputs an output signal (voltage) in response to the amount of light reflected. A reference toner image of a predetermined shape is then formed on a surface of a photosensitive element and is transferred onto the intermediate transfer belt. The light-emitting element then emits light so that the emitted light is reflected on the reference toner image as a detection target and the light-receiving element receives the reflected light and outputs the output signal in response to the light reflected. Thereafter, with the output signal of the bare surface of the intermediate transfer belt as a reference value, the output signal of the reference toner image is compared with the reference value to know the amount of toner adhered per unit area of the reference toner image. Based on the amount of toner adhered thus acquired, image forming conditions such as uniformly charged electrical potential of the photosensitive element, developing bias, writing light intensity for the photosensitive element, and a target control value of toner density of developer are adjusted so as to obtain a desired amount of toner adhered.

Such image quality adjustment control enables printouts in stable image density over an extended period of time.

The light-receiving element of the optical sensor may receive light other than the light reflected from a detection target such as the intermediate transfer belt or the reference toner image formed on the intermediate transfer belt. The output signal of the light-receiving element by the light other than the light reflected from the detection target is referred to as a crosstalk (or a crosstalk voltage, when the output signal is a voltage signal). Because the crosstalk deteriorates detecting accuracy of the detection target, it is desirable to keep the crosstalk as low level as possible.

The occurrence factors of the crosstalk include:

1. the light reflected from a case member covering a light-emitting element and a light-receiving element,
2. the light incident to the light-receiving element directly from the light-emitting element, and
3. the light reflected from a condenser lens or the like.

The first factor is suppressed, for example, by finishing the case member in non-glossy black, making it hard to reflect light.

The second factor is suppressed, as disclosed in Japanese Patent Application Laid-open No. 2005-24459, by providing the case member with a light blocking wall that blocks the light incident to the light-receiving element directly from the light-emitting element.

The third factor is suppressed by using a condenser lens of a higher transmittance.

However, even with those measures taken, it is not possible to eliminate the crosstalk completely, and thus the output signal of the detection target contains a noise signal (crosstalk) making it difficult to improve the detecting accuracy of the detection target.

SUMMARY OF THE INVENTION

It is an object of the present invention to at least partially solve the problems in the conventional technology.

According to an aspect of the present invention, there is provided an optical sensor including: a light-emitting unit; a light-receiving unit that receives light radiated from the light-emitting unit and reflected from a detection target and that outputs an output value in response to the light received; and a correcting unit that corrects the output value of the light-receiving unit when receiving the light reflected from the detection target based on the output value of the light-receiving unit obtained by irradiating a detection area of the optical sensor with light without any light reflective objects being present in the detection area.

According to another aspect of the present invention, there is provided An image forming apparatus including: an image carrier that supports a toner image on a surface thereof; an optical sensor that detects light reflected from the toner image; and an image quality adjustment control unit that forms an image quality adjustment toner image on the surface of the image carrier and carries out image quality adjustment control based on an output value of the optical detecting unit when receiving the light reflected from the image quality adjustment toner image. The optical sensor including: a light-emitting unit; a light-receiving unit that receives light radiated from the light-emitting unit and reflected from a detection target and that outputs an output value in response to the light received; and a correcting unit that corrects the output value of the light-receiving unit when receiving the light reflected from the detection target based on the output value of the light-receiving unit obtained by irradiating a detection area of the optical sensor with light without any light reflective objects being present in the detection area.

According to still another aspect of the present invention there is provided an image forming apparatus including: an image carrier that supports a toner image on a surface thereof; an optical sensor including a light-emitting unit and a light-receiving unit that receives light radiated from the light-emitting unit and reflected from the toner image on the surface of the image carrier and that outputs an output value in response to the light; and an image quality adjustment control unit that forms an image quality adjustment toner image on the surface of the image carrier and carries out image quality adjustment control based on the output value of the light-receiving unit when receiving the light reflected from the image quality adjustment toner image. The image quality adjustment control unit corrects the output value of the light-receiving unit obtained when receiving light reflected from the image quality adjustment toner image, based on the output value of the light-receiving unit obtained by radiating a detection area of the optical sensor with light without any light reflective objects being present in the detection area, and carries out the image quality adjustment control based on the output value thus corrected.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
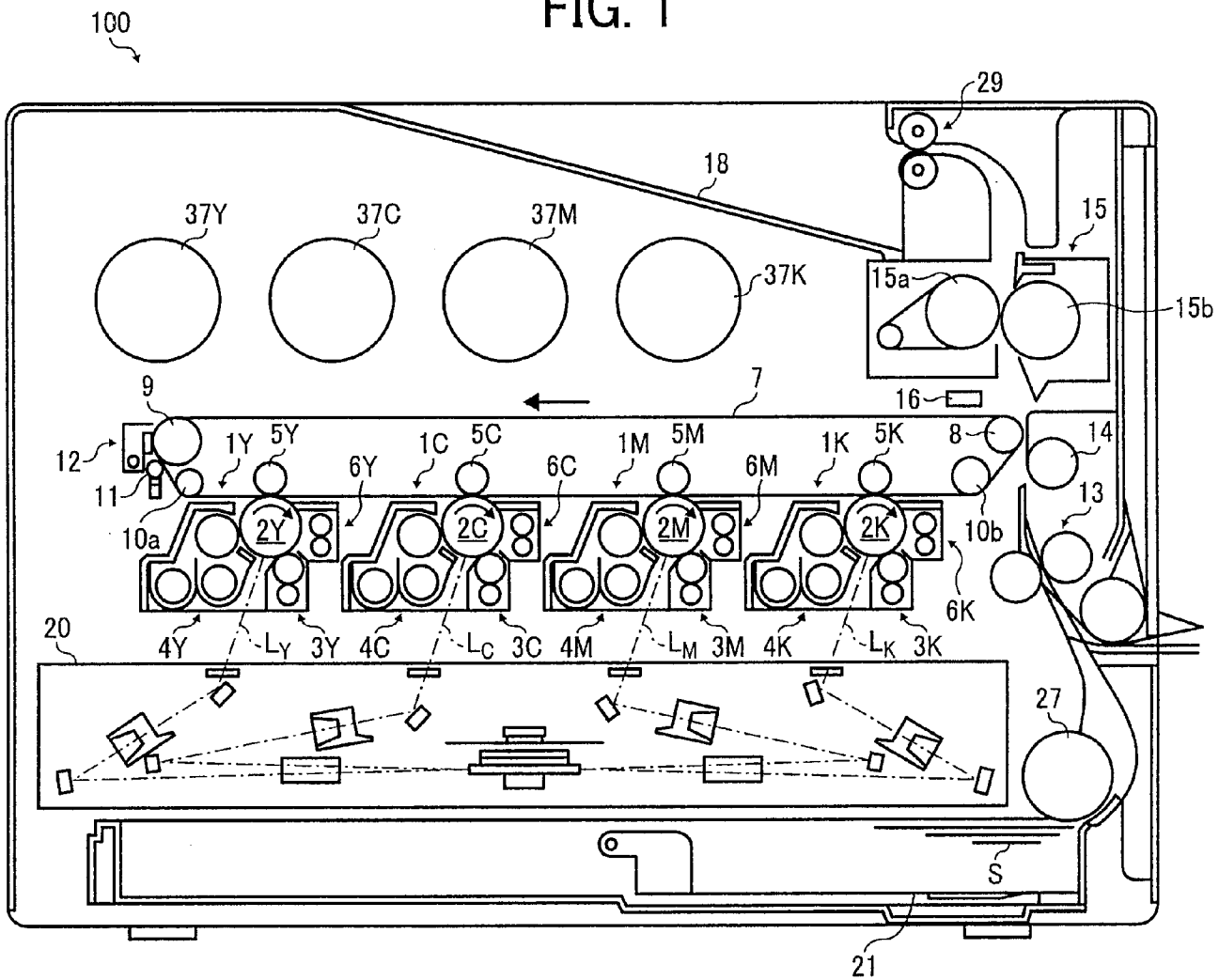
FIG. 1 is a schematic diagram of a printer according to an embodiment of the present invention.

An embodiment of the present invention applied to a full color printer (hereinafter, referred to as "printer") 100 that is an image forming apparatus will be explained below. FIG. 1 is a schematic diagram illustrating a structure of the printer 100. The printer 100, as illustrated in FIG. 1, is provided with a locationally-fixed apparatus body that houses respective constituent elements of a print image forming unit, and a pullout paper feed cassette 21 that stores therein a recording medium S. In the central section of the apparatus body, image forming units 1Y, 1C, 1M, and 1K that form toner images in yellow (Y), cyan (C), magenta (M), and black (K), respectively, are provided. Hereinafter, the suffixes Y, C, M, and K represent members for yellow, cyan, magenta, and black colors, respectively.

Figure 2:
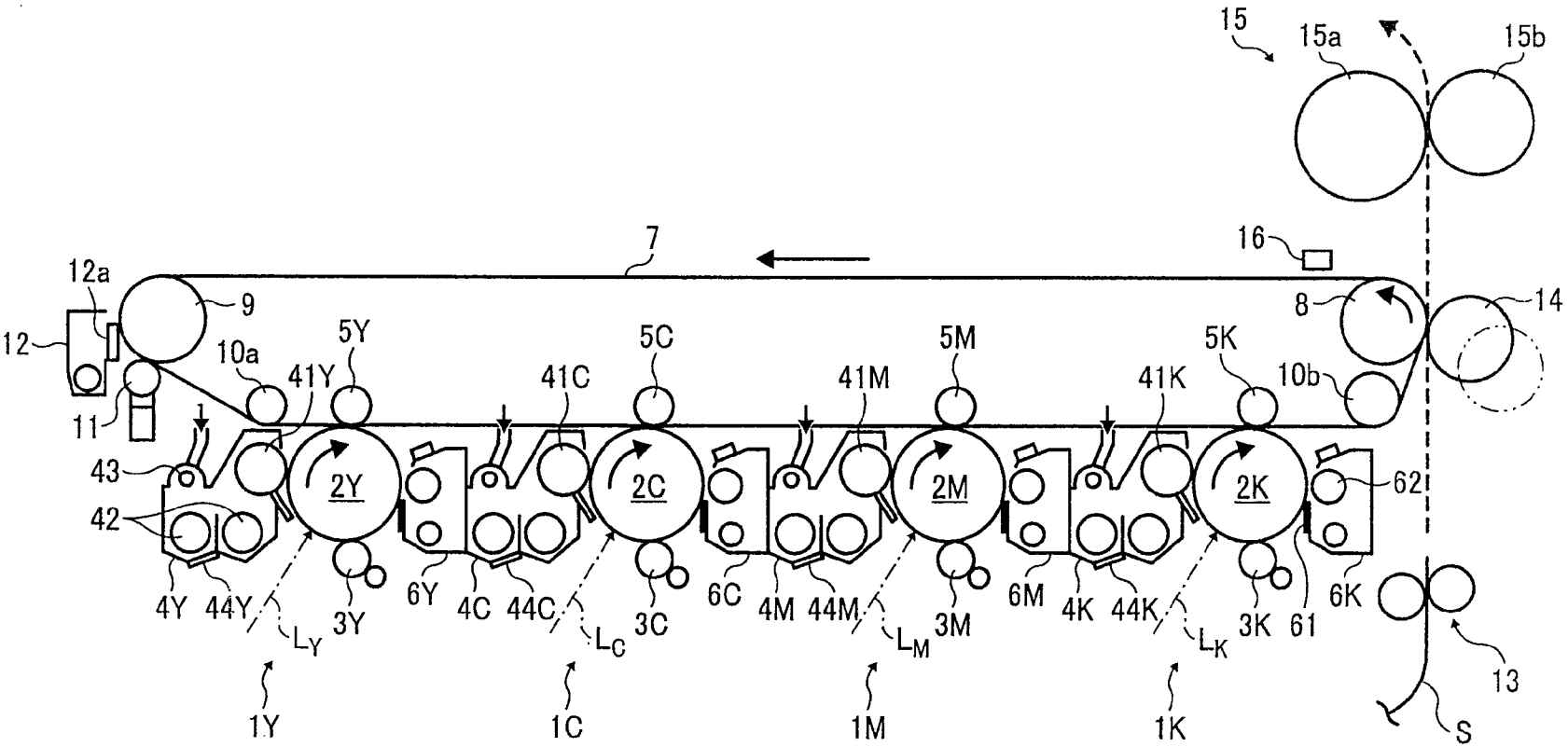
FIG. 2 is a schematic diagram of a print image forming unit.

FIG. 2 is a schematic diagram illustrating the print image forming unit. As illustrated in FIGS. 1 and 2, in the present embodiment, as a unit at least having photosensitive elements 2Y, 2C, 2M, and 2K in a drum shape as image carriers (hereinafter, also referred to as "photosensitive element 2" collectively), charging rollers 3Y, 3C, 3M, and 3K as charging units, a laser exposure device 20 as an image writing unit (an exposing unit), developing devices 4Y, 4C, 4M, and 4K (hereinafter, also referred to as "developing device 4" collectively) as developing units, and cleaning devices 6Y, 6C, 6M, and 6K that remove transfer residual toner on the surfaces of the photosensitive elements, a plurality of sets of image forming units 1Y, 10, 1M, and 1K for respective colors (four sets in the present embodiment) is structured. The image forming units 1Y, 1M, 10, and 1K for colors yellow (Y), magenta (M), cyan (C), and black (K) are disposed in the order of Y, C, M, and K from the left, facing to and under a laterally extended portion of an intermediate transfer belt 7 as an image carrier traveling in a loop. The four sets of image forming units 1Y, 10, 1M, and 1K for respective colors are structured in the same manner.

The charging rollers 3Y, 3C, 3M, and 3K electrically charge the photosensitive elements 2Y, 2C, 2M, and 2K in the same polarity as the respective toner maintained at a specified potential (a negative charge in the present embodiment) to provide the photosensitive elements 2Y, 2C, 2M, and 2K a uniform potential, respectively. The charging unit is not limited to the charging roller, and various charging units such as a charging brush, and a electric charger may appropriately be used.

The laser exposure device 20 exposes the photosensitive elements 2Y, 2C, 2M, and 2K on the downstream side of the charging rollers 3Y, 3C, 3M, and 3K and on the upstream side of the developing devices 4Y, 4C, 4M, and 4K in the rotation direction of the photosensitive elements 2Y, 2C, 2M, and 2K. The laser exposure device 20 is arranged such that exposure light beams are scanned in parallel to the rotation axes of the photosensitive elements 2Y, 2C, 2M, and 2K in a main-scanning direction.

The laser exposure device 20 includes, for example, a light source composed of a semiconductor laser (LD), a coupling optical system (or a beam shaping optical system) including a collimated lens and a cylindrical lens, a light deflector including a rotational multi-facet mirror, and an image focusing optical system that focuses the laser light deflected by the light deflector onto the photosensitive element 2. Photosensitive layers of the photosensitive elements 2Y, 2C, 2M, and 2K for respective colors are image-exposed by the laser light $L_Y$, $L_C$, $L_M$, and $L_K$ that are intensity-modulated according to image data of the respective colors read by a separately structured image reading device not illustrated and stored in a memory (or image data of respective colors input from an external device such as a personal computer) to form electrostatic latent images of respective colors. As for an image writing unit (exposing unit), in place of the laser exposure device 20, an LED writing device, for example, combined with a light-emitting diode array (LED array), a lens array, and the like may also be used.

The photosensitive elements 2Y, 2C, 2M, and 2K each have, on an undercoating layer formed on a surface of a conductive cylindrical supporting body, a charge generating layer (lower layer) and a charge transport layer (upper layer) that are stacked in this order or in the reverse order as the photosensitive layers. On the surface of the charge transport layer or the charge generating layer, a known surface protection layer such as an overcoat layer mainly composed of a thermoplastic or thermosetting polymer may also be formed. In the present embodiment, the conductive cylindrical supporting bodies of the photosensitive elements 2Y, 2C, 2M, and 2K are grounded.

The developing devices 4Y, 4C, 4M, and 4K have cylindrical, non-magnetic developing sleeves 41Y, 41C, 41M, and 41K (hereinafter, also referred to as "developing sleeve 41" collectively) made of stainless steel or aluminum that rotate in a forward direction with respect to the rotation direction of the photosensitive element 2 while maintaining a predetermined gap to the circumferential surface of the photosensitive element 2. Each of the developing device 4 contains inside a single or dual component developer in yellow (Y), magenta (M), cyan (C), or black (K) according to the developing color thereof. In the present embodiment, as an example, each of the developing device 4 contains inside a dual component developer composed of toner and magnetic carrier (in the present embodiment, the toner is negatively charged). In this case, a plurality of stationary magnets or a magnet roll magnetized with a plurality of magnetic poles is arranged inside the developing sleeve 41. The developing devices 4Y, 4C, 4M, and 4K are provided each with a stirring and conveying member 42 that conveys the developer in a container while stirring and a replenishing unit 43 where the toner is replenished from a toner bottle 37 for each color. Furthermore, the developing devices 4Y, 4C, 4M, and 4K for respective colors are provided as necessary with toner density sensors 44Y, 44C, 44M, and 44K that detect toner density of the developer in the respective containers.

The developing sleeves 41Y, 41C, 41M, and 41K of the developing devices 4Y, 4C, 4M, and 4K are kept non-contact with the drum surfaces of the respective photosensitive elements 2Y, 2C, 2M, and 2K with a given gap of, for example, 100 to 500 micrometers by stopping rollers or the like not illustrated. The developing sleeves 41Y, 41C, 41M, and 41K are applied with developing bias of a DC voltage superimposed with an AC voltage to carry out contact or non-contact reversal development to form toner images on the surfaces of the photosensitive elements 2Y, 2C, 2M, and 2K.

The cleaning devices 6Y, 6C, 6M, and 6K each have, for example, a cleaning blade 61 and a cleaning roller (or cleaning brush) 62, and the cleaning blade 61 is provided in contact with the surface of the respective photosensitive element in a counter direction.

A drive roller 8 that also serves as a secondary transfer backup roller, a support roller 9, tension rollers 10*a* and 10*b*, and a backup roller 11 contact the internal surface of the intermediate transfer belt 7, that is an intermediate transfer body and an image carrier, and supports the intermediate transfer belt 7 in a tensioned state. The rotation direction of the intermediate transfer belt 7 is in the counter-clockwise direction indicated by the arrow in FIGS. 1 and 2.

A secondary transfer roller 14 is provided facing the drive roller 8 via the intermediate transfer belt 7 therebetween. A cleaning blade 12*a* of a belt cleaning device 12 is provided in contact with the intermediate transfer belt 7 in the counter direction at the position of the support roller 9. Primary transfer rollers 5Y, 5C, 5M, and 5K for the respective colors are similarly provided facing the photosensitive elements 2Y, 2C, 2M, and 2K with the intermediate transfer belt 7 therebetween. The intermediate transfer belt 7 is driven by the rotation of the drive roller 8 that is driven by a drive motor not illustrated.

The primary transfer rollers 5Y, 5C, 5M, and 5K are provided facing the photosensitive elements 2Y, 2C, 2M, and 2K, respectively, with the intermediate transfer belt 7 therebetween to form transfer areas between the intermediate transfer belt 7 and the photosensitive elements 2Y, 2C, 2M, and 2K. The primary transfer rollers 5Y, 5C, 5M, and 5K are applied each with a DC voltage of the reverse polarity to the toner (positive polarity in the present embodiment) from a DC power supply not illustrated forming a transfer electric field in the transfer area, thereby transferring toner images of the respective colors formed on the photosensitive elements 2Y, 2C, 2M, and 2K onto the intermediate transfer belt 7.

The secondary transfer roller 14 that transfers the toner images to the surface of the recording medium S is provided facing the drive roller 8, which is grounded, with the intermediate transfer belt 7 therebetween. The secondary transfer roller 14 is applied with a DC voltage in the reverse polarity to the toner (positive polarity in the present embodiment) from the DC power supply, thereby transferring the overlaid toner images supported on the intermediate transfer belt 7 onto the surface of the recording medium S via the secondary transfer roller 14.

The recording medium S such as recording paper is conveyed from the paper feed cassette 21 one sheet at a time by a paper feed roller 27 passing through registration rollers 13 so as to overlap the intermediate transfer belt 7 being nipped with the secondary transfer roller 14 and the drive roller 8 that constitute a secondary transfer section, and the toner image is transferred thereon from the intermediate transfer belt 7 at the secondary transfer section. The recording medium S is then conveyed to a fixing device 15 that is a fixing unit where the toner image is fixed by thermal fusion with a fixing roller 15*a* and a pressure roller 15*b* of the fixing device 15, and is delivered to a discharging unit 18.

Figure 11:
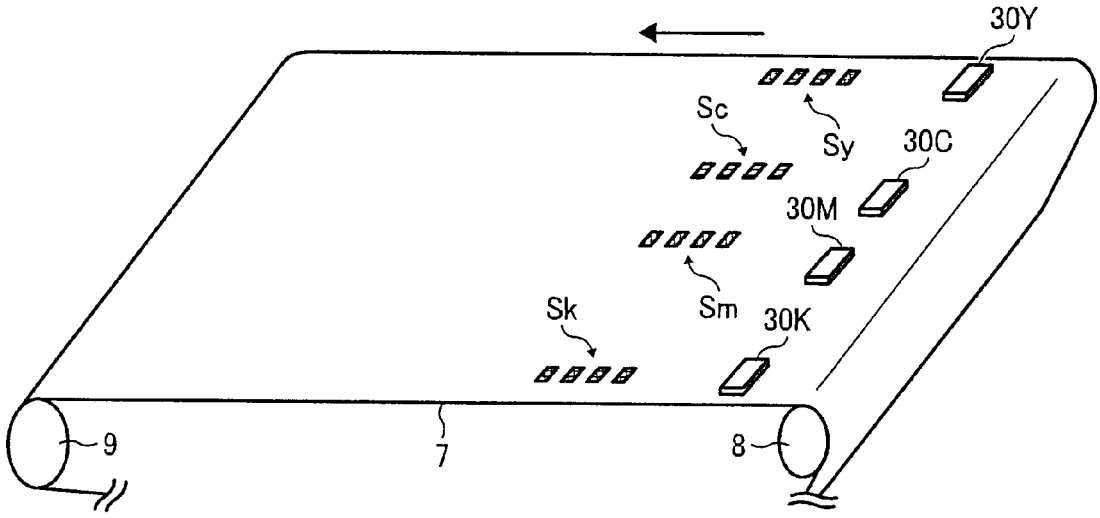
FIG. 11 is an enlarged schematic view of the vicinity of an intermediate transfer belt illustrating pattern forming positions and the disposed positions of optical sensors.

In the image forming apparatus according to the present embodiment, an optical sensor unit 16 is provided with a plurality of optical sensors 30, and is disposed on the downstream side of the rotation direction of the intermediate transfer belt 7 from the secondary transfer section, facing to the outer surface of the intermediate transfer belt 7 where the intermediate transfer belt 7 is wound around the drive roller 8 with a given clearance from the outer surface (see FIG. 11). The optical sensor unit 16 detects later described gradation patterns formed on the intermediate transfer belt 7. More specifically, as illustrated in FIG. 11, the optical sensor unit 16 includes an optical sensor 30K that detects gradation patterns Sk in K color, an optical sensor 30M that detects gradation patterns Sm in M color, an optical sensor 30C that detects gradation patterns Sc in C color, and an optical sensor 30Y that detects gradation patterns Sy in Y color. In the following explanation, when it is not necessary to distinguish the optical sensors for respective colors, the suffix indicative of color will be omitted.

Figure 3:
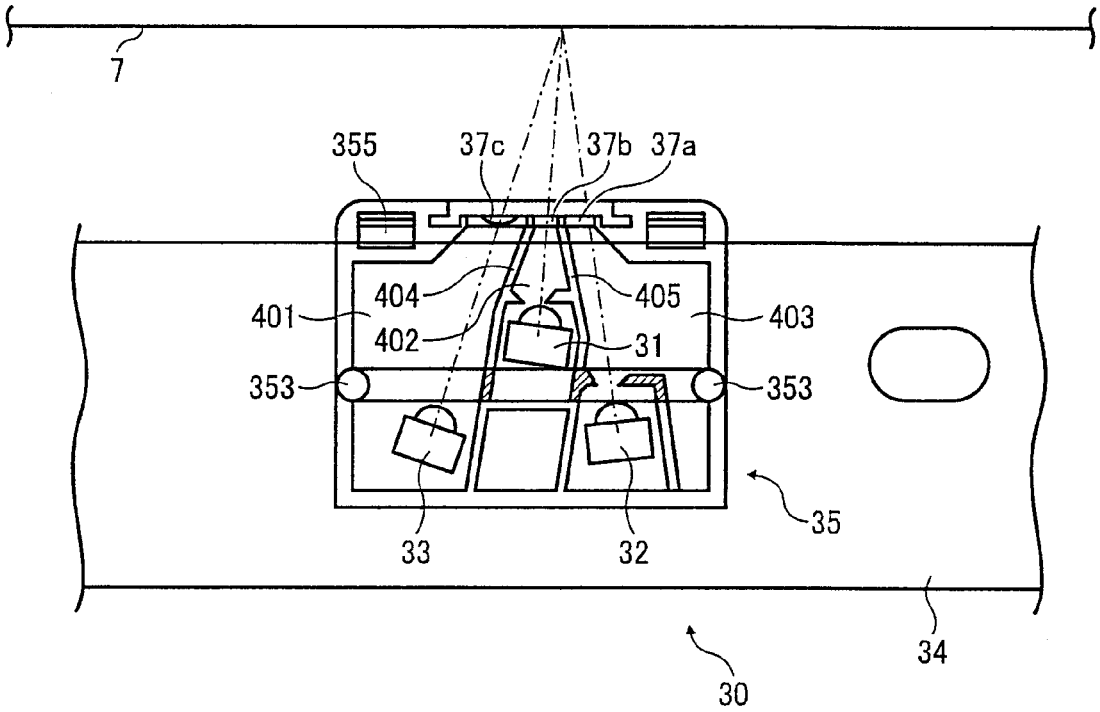
FIG. 3 is a schematic diagram of an optical sensor 30.
Figure 4A:
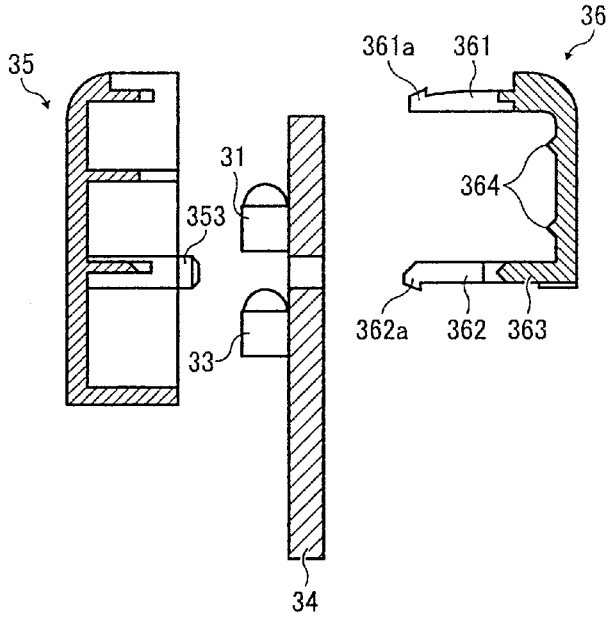
FIGS. 4A and 4B are cross-sectional views of the optical sensor.
Figure 4B:
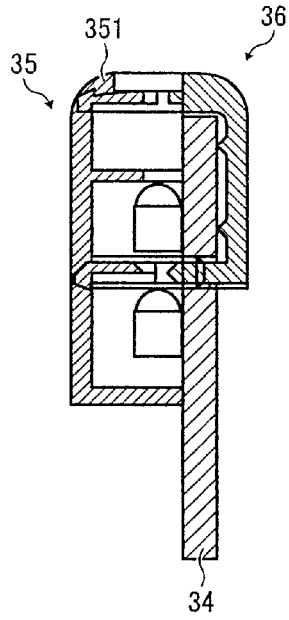

FIG. 3 is a schematic diagram of the optical sensor 30 according to the present embodiment, and FIGS. 4A and 4B are cross-sectional views of the optical sensor 30.

The optical sensor 30 according to the present embodiment has a light-emitting element 31 as a light-emitting unit, and a first light-receiving element 32 and a second light-receiving element 33 as light-receiving units that receive reflected light. The respective elements 31, 32, and 33 are mounted on a printed circuit board 34, and are enclosed in an upper case 35. In the upper case 35, a passageway 402 to secure an output light path for light radiated by the light-emitting element 31 and incident to the intermediate transfer belt 7 or a toner image on the intermediate transfer belt (hereinafter, referred to as "detection target") and passageways 401 and 403 to secure incident light paths for the light reflected from the detection target reaching the first light-receiving element 32 and the second light-receiving element 33 are formed. The space formed by the light-emitting element 31 and the passageway 402 and the space formed by the first light-receiving element 32 and the passageway 403 are separated by a light blocking wall 405, thereby preventing the light from the light-emitting element 31 from being incident to the first light-receiving element 32 directly. The space formed by the light-emitting element 31 and the passageway 402 and the space formed by the second light-receiving element 33 and the passageway 401 are separated by a light blocking wall 404, thereby preventing the light from the light-emitting element 31 from being incident to the second light-receiving element 33 directly. A condenser lens 37*b* is disposed on the output light path of the upper case 35. Condenser lenses 37*a* and 37*c* are also disposed on the incident light paths. The upper case 35 is fixed onto the printed circuit board 34, as illustrated in FIG. 4B, by fitting it with a lower case 36 with the printed circuit board 34 therebetween.

The light output from the light-emitting element 31 propagating along the surface of the printed circuit board 34 is refracted by the condenser lens 37*b* and is focused on the surface of the detection target (intermediate transfer belt 7 or toner image). The specularly reflected light from the detection target passes through the condenser lens 37*a*, travels along the surface of the printed circuit board 34, and is incident to the first light-receiving element 32. The diffusely reflected light from the toner image passes through the condenser lens 37*c*, travels along the surface of the printed circuit board 34, and is incident to the second light-receiving element 33.

The condenser lenses 37*a* to 37*c* are not indispensable and may be eliminated and, in place of the condenser lenses, members such as transparent sheets or transparent films for dust-proofing may be used. Furthermore, in place of the lenses, filters selecting wavelengths may be used.

The optical sensor 30 has tolerances on component parameters, assembly variations, and the like, which cannot be totally ruled out, whereby the crosstalk voltage cannot be eliminated completely. Further, in terms of detection accuracy, the need arises to reduce noise information (crosstalk voltage) that has been tolerable.

In the present embodiment, therefore, a crosstalk voltage is detected first, and when the light-receiving element receives light reflected from the detection target, the detected crosstalk voltage is subtracted from an output voltage of the light-receiving element to remove the crosstalk voltage. A structure for detecting the crosstalk voltage will be explained using a first embodiment and a second embodiment below.

First Embodiment

Figure 5:
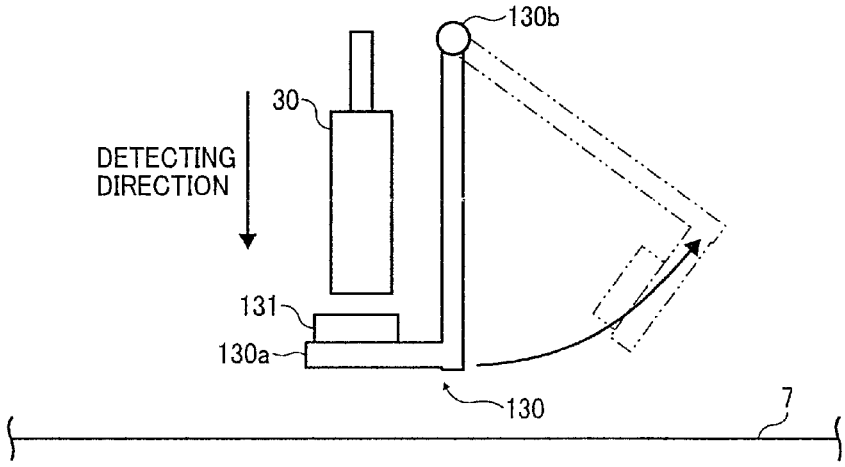
FIG. 5 is a schematic illustrating a structure for detecting a crosstalk voltage according to a first embodiment of the present invention.

FIG. 5 is a schematic illustrating a structure for detecting a crosstalk voltage according to a first embodiment of the present invention.

In the first embodiment, as illustrated in FIG. 5, a shutter member 130 is provided for preventing dust and the like from adhering onto the condenser lenses 37*a* to 37*c* of the optical sensor 30. The shutter member 130 has a facing portion 130*a* facing the condenser lenses 37*a* to 37*c* of the optical sensor 30, and the facing portion 130*a* is provided with a light absorber 131 that is a non-reflective object. The light absorber 131 is a member having a reflectance ratio of 0% or substantially 0%, like a one in non-glossy black. The shutter member 130 is rotatably supported about a supporting portion 130*b*. The shutter member 130 can be provided on the optical sensor 30 or on the printer 100.

When detecting the crosstalk voltage, the shutter member 130 is positioned at the position illustrated in FIG. 5 in bold lines such that the light absorber 131 faces the condenser lenses 37*a* to 37*c*. Accordingly, no light reflective objects are present in the detection area of the optical sensor 30, and the light radiated from the light-emitting element 31 to the light absorber 131 is not reflected and thus, the first light-receiving element 32 and the second light-receiving element 33 receive no reflected light. Therefore, the output voltage of the first light-receiving element 32 and the output voltage of the second light-receiving element 33 thus obtained in this case are the output voltages by other than the light reflected from the detection target, i.e., the crosstalk voltages. Consequently, the crosstalk voltage of the first light-receiving element 32 and the crosstalk voltage of the second light-receiving element 33 are detected.

When detecting the detection target (surface of the intermediate transfer belt 7 and toner images on the intermediate transfer belt 7), the shutter member 130 is moved to the position illustrated in FIG. 5 in broken lines. Accordingly, the first light-receiving element 32 can receive the specularly reflected light from the detection target and the second light-receiving element 33 can receive the diffusely reflected light from the detection target.

Second Embodiment

Figure 6A:
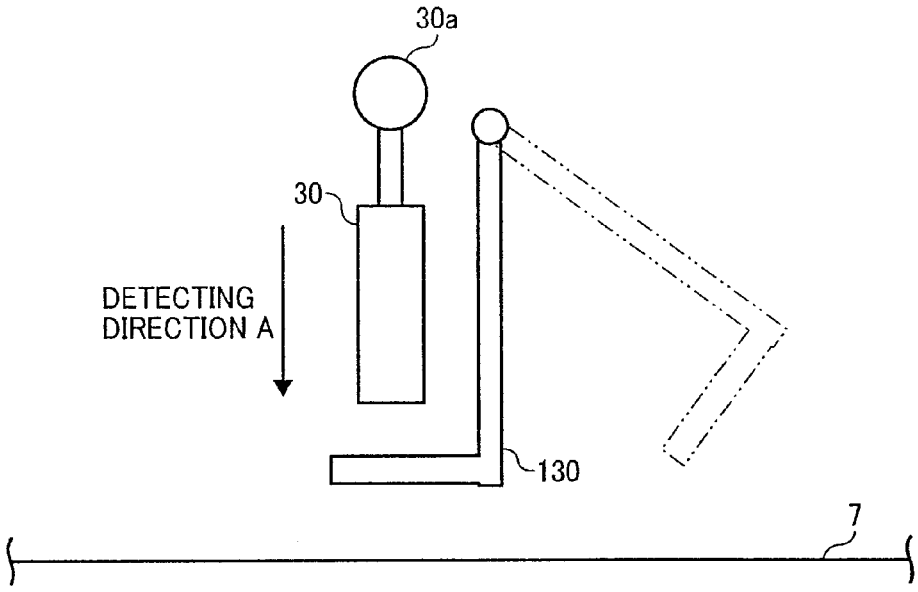
FIGS. 6A and 6B are schematics illustrating a structure for detecting the crosstalk voltage according to a second embodiment of the present invention.
Figure 6B:
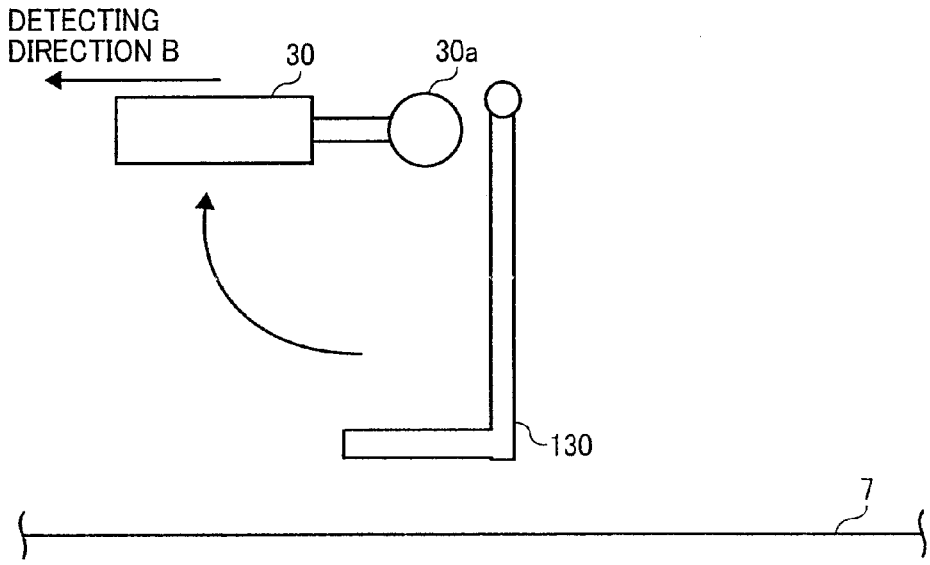

FIGS. 6A and 6B are schematics illustrating a structure for detecting the crosstalk voltage according to a second embodiment of the present invention.

In the second embodiment, the optical sensor 30 is rotatably supported such that the condenser lenses 37*a* to 37*c* of the optical sensor 30 can take a position facing the intermediate transfer belt 7 as illustrated in FIG. 6A and a position facing no light reflective objects as illustrated in FIG. 6B.

When detecting the crosstalk voltage, as illustrated in FIG. 6B, the optical sensor 30 is rotated such that the light radiating direction (detecting direction) of the optical sensor 30 comes to the direction indicated by an arrow B. In the arrow B direction, no objects are disposed at least in the detectable range of the optical sensor 30. If there is any, the member disposed is a member having a reflectance ratio of 0% or substantially 0%, like the one in non-glossy black. Accordingly, no light reflective objects are present in the detection area of the optical sensor 30 and thus, the light radiated from the light-emitting element 31 is not reflected, making the first light-receiving element 32 and the second light-receiving element 33 receive no reflected light. Consequently, detecting the output voltage of the first light-receiving element 32 and the output voltage of the second light-receiving element 33 makes it possible to detect the respective crosstalk voltages.

On the other hand, when detecting the detection target (surface of the intermediate transfer belt 7 or toner images on the intermediate transfer belt 7), as illustrated in FIG. 6A, the optical sensor 30 is rotated such that the light radiating direction (detecting direction) of the optical sensor 30 comes to the direction indicated by an arrow A. The shutter member 130 is moved to the position illustrated in FIG. 6A in broken lines. Accordingly, the first light-receiving element 32 receives the specularly reflected light from the detection target and the second light-receiving element 33 receives the diffusely reflected light from the detection target. In the second embodiment, the shutter member 130 is not indispensable and may be eliminated.

Figure 9:
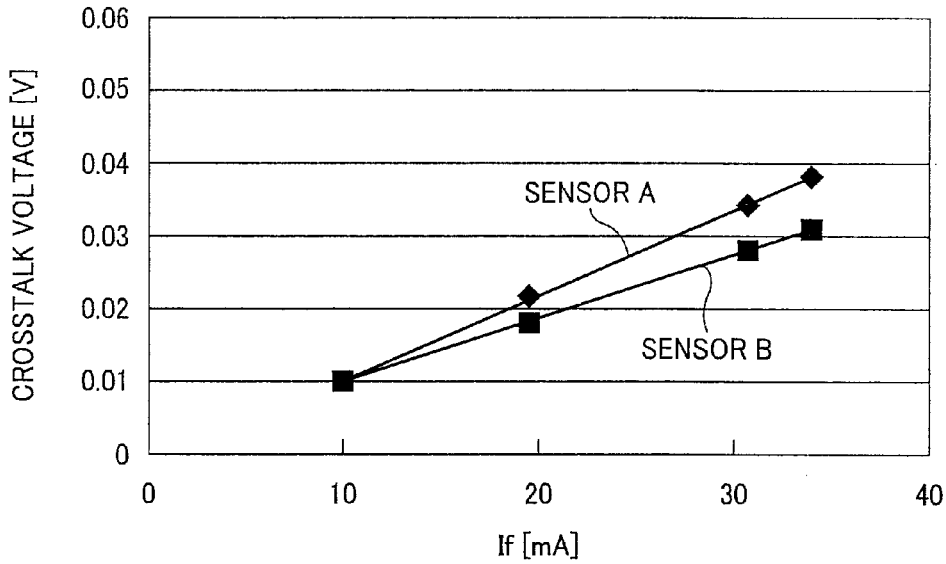
FIG. 9 is a graph illustrating the relations of the crosstalk voltage and a supply current If supplied to a light-emitting element.

The crosstalk voltage, as illustrated in FIG. 9, differs depending on the optical sensors and thus, each of the optical sensors 30Y, 30M, 30C, and 30K is provided with the structure for detecting crosstalk voltage according to the first embodiment or the second embodiment.

Figure 7:
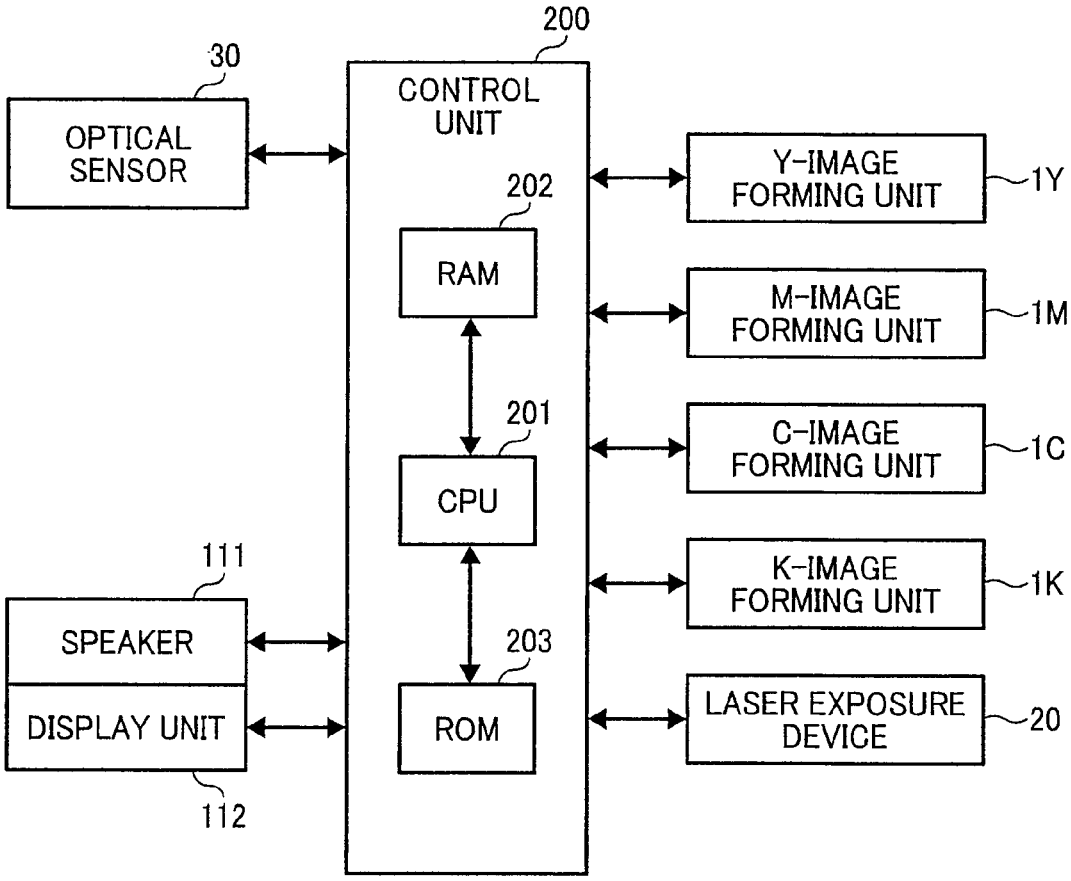
FIG. 7 is a block diagram illustrating relevant sections of an electrical circuit of the printer.

FIG. 7 is a block diagram illustrating primary sections of an electrical circuit of the printer 100. In FIG. 7, a control unit 200 that is a control unit includes a central processing unit (CPU) 201 that is a calculating unit, a non-volatile random access memory (RAM) 202 that is a data storage unit, and a read only memory (ROM) 203 that is a data storage unit. The control unit 200 is electrically coupled with the image forming units 1Y, M, C, and K, the laser exposure device 20, the optical sensor 30, and the like. The control unit 200 is also electrically coupled with an informing unit such as a display unit 112 and a speaker 111. The control unit 200 is operative to control these various devices based on a control program stored in the RAM 202. The RAM 202 that is a non-volatile memory stores therein the crosstalk voltage of the first light-receiving element 32 and the crosstalk voltage of the second light-receiving element 33 of the optical sensor 30. The crosstalk voltages for the optical sensors 30Y, 30M, 30C, and 30K are each stored.

The control unit 200 also controls image forming conditions for forming image. More specifically, the control unit 200 carries out the control of individually applying the charging bias to the respective charging members of the image forming units 1Y, M, C, and K. Accordingly, the photosensitive elements 2Y, M, C, and K for respective colors are uniformly charged at drum potentials for Y, M, C, and K colors. The control unit 200 individually controls the powers of four semiconductor lasers corresponding to the image forming units 1Y, M, C, and K in the laser exposure device 20. The control unit 200 further carries out the control of applying the developing bias of developing bias values for Y, M, C, and K colors to the respective developing rollers of the image forming units 1Y, M, C, and K. This leads the developing potential, which transfers toner from the surfaces of the developing sleeves to the photosensitive elements in an electrostatic manner, to act between electrostatic latent images on the photosensitive elements 2Y, M, C, and K and the respective developing sleeves, thereby developing the electrostatic latent images.

The control unit 200 carries out an image density control for optimizing image density of the respective colors every time the power is turned on or a specific number of printouts are made. In other words, the control unit 200 has a function as an image quality adjustment control unit.

Figure 8:
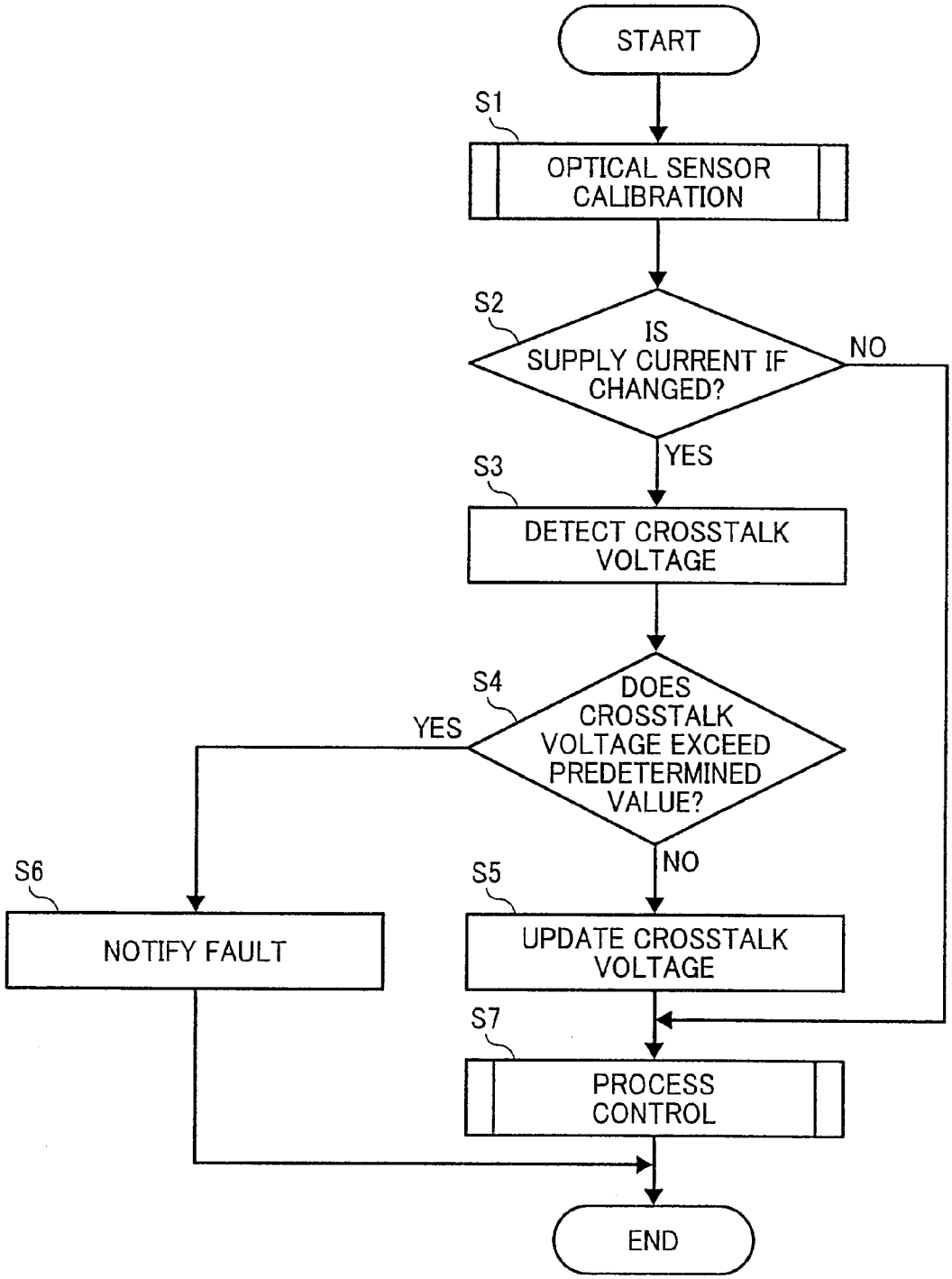
FIG. 8 is a flowchart of an image density control.

FIG. 8 is a flowchart of the image density control.

First, the control unit 200 calibrates the optical sensors 30Y, 30M, 30C, and 30K (S1). In the calibration of the optical sensor 30, the intermediate transfer belt 7 is irradiated with light and the specularly reflected light is received by the first light-receiving element 32. The output voltage of the first light-receiving element 32 is checked whether it falls within a predetermined range. When it is not within the predetermined range, the light-emitting intensity of the light-emitting element 31 is adjusted by adjusting a supply current If supplied to the light-emitting element 31 of the optical sensor 30 so that the output voltage of the first light-receiving element 32 falls within the predetermined range. Such calibration operation makes it possible to prevent the output voltages of the light-receiving element 32 and the light-receiving element 33 from fluctuating by the fluctuation of light-emitting intensity caused by an individual difference in luminance efficiency of the light-emitting element 31, temperature fluctuations, variations with time, and the like, thereby measuring the toner image density highly accurately. On the contrary, when the output voltage of the first light-receiving element 32 falls within the predetermined range, the calibration process of the optical sensor 30 is finished without any further adjustment. Accordingly, the control unit 200 has a function as a light emitting amount adjustment unit that adjusts the light emitting amount of the light-emitting element 31 by varying the value of current supplied to the light-emitting element 31 with the output voltage of the first light-receiving element 32 being referred to.

FIG. 9 is a graph depicting the relations of the crosstalk voltage and the supply current If supplied to the light-emitting element 31. The larger the supply current If supplied to the light-emitting element 31 becomes, the stronger the light intensity of the light-emitting element 31 becomes, and therefore, the crosstalk voltage increases. Accordingly, in the calibration process of the optical sensor 30, when the supply current If is changed (YES at S2), the detection of crosstalk voltages of the first light-receiving element 32 and the second light-receiving element 33 are carried out (S3). The crosstalk voltages are detected in manners explained in the first embodiment and the second embodiment. If the detected crosstalk voltage departs largely from a normal value, it is assumed that the optical sensor 30 itself is faulty. Therefore, when the crosstalk voltage detected exceeds the predetermined value (YES at S4), the display unit 112 displays that the optical sensor 30 is faulty and the speaker 111 sounds an alarm to notify the user of the fault (S6) to prompt the user to replace the optical sensor, and the process is terminated without carrying out the process control.

On the other hand, when the crosstalk voltage detected falls below the predetermined value (NO at S4), the crosstalk voltage stored in the RAM 202 is updated to the detected crosstalk voltage (S5).

After the preliminary process such as the calibration of the optical sensors 30Y, 30M, 30C, and 30K and the detection of crosstalk voltages is completed, the control unit 200 carries out the process control (S7).

Figure 10:
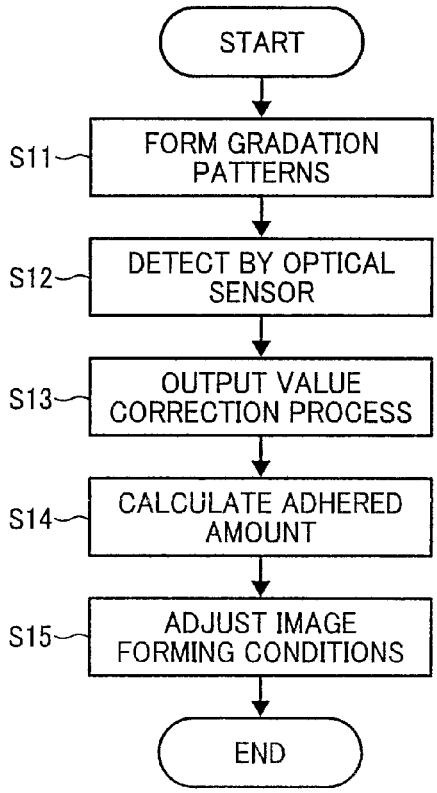
FIG. 10 is a control flowchart of process control.

FIG. 10 is a control flowchart of the process control.

In the process control, the gradation patterns for respective colors Sk, Sm, Sc, and Sk are automatically formed at positions, as illustrated in FIG. 11, on the intermediate transfer belt 7 facing the respective optical sensors 30Y, M, C, and K (S11). More specifically, the photosensitive elements 2Y, M, C, and K are uniformly charged while rotating. The charged potential in this case is different from the drum potential uniformly charged in printing process and the value of the charged potential is gradually increased. While a plurality of patches of electrostatic latent images that form gradation pattern images is being formed by scanning the laser beams on the respective photosensitive elements 2Y, M, C, and K, the images are developed by the developing devices for Y, M, C, and K colors. When developing, the control unit 200 gradually increases the values of the developing bias applied to the developing rollers for Y, M, C, and K colors. Developing in such manner makes the gradation pattern images for Y, M, C, and K colors to be formed on the photosensitive elements 2Y, C, M, and K. These images are primary transferred onto the intermediate transfer belt 7 so as to be aligned at predetermined intervals in the main-scanning direction.

The gradation patterns (Sk, Sm, Sc, and Sy) formed on the intermediate transfer belt 7 pass the position facing the optical sensor 30 along with the endless movement of the intermediate transfer belt 7. At this time, the optical sensor 30 receives light of which the amount depends to the amount of toner adhered per unit area in each toner patch of the respective gradation patterns (S12). With the toner in K color, because the radiated light is absorbed at the toner surface, the received light hardly contains the diffusely reflected light component and thus, it can be neglected. Accordingly, the optical sensor 30K for K color detects the amount of toner adhered based on the output voltage of the first light-receiving element 32 that receives the specularly reflected light. Meanwhile, with the color toners in Y, M, and C colors, because the light irradiated to the toner surface is diffusely reflected, the light received by the first light-receiving element 32 of the optical sensor 30 contains a lot of diffusely reflected light other than the specularly reflected light. Accordingly, each of the optical sensors 30Y, 30M, and 30C uses the output voltage of the second light-receiving element 33 that receives the diffusely reflected light to detect the adhered amount. However, because the output voltages of the optical sensors 30Y, 30M, 30C, and 30K obtained by detecting the toner patches of the respective gradation patterns contain the crosstalk voltages, they cannot be called as highly accurately detected values. Therefore, the control unit 200 carries out an output value correction process that removes the crosstalk voltage component from the output voltage of the optical sensor 30 obtained by detecting the toner patches of the respective gradation patterns (S13).

In the output value correction process, the crosstalk voltage stored in the RAM 202 is read out. For the optical sensor 30K that detects the toner patches of gradation patterns in K color, the crosstalk voltage corresponding to the first light-receiving element 32 of the optical sensor 30K is read out from the RAM 202. The crosstalk voltage of the first light-receiving element 32 read out from the RAM 202 is subtracted from the output voltage of the first light-receiving element 32 obtained when detecting the toner patches. As a result, the output voltage of the first light-receiving element 32 is obtained with the crosstalk voltage removed. Meanwhile, for the optical sensors 30Y, M, and C that detect toner patches of gradation patterns in Y, M, and C colors, the crosstalk voltages of the second light-receiving elements 33 of the corresponding optical sensors 30Y, M, and C are read out from the RAM 202. The crosstalk voltages of the second light-receiving elements 33 read out are subtracted from the output voltage of the corresponding second light-receiving elements 33 obtained when detecting the respective toner patterns. As a consequence, the output voltages are obtained with the crosstalk voltages removed.

Based on the output voltage of the optical sensor with the crosstalk voltage removed by the output value correction process, the adhered amount of each toner patch is then calculated (S14).

Figure 12:
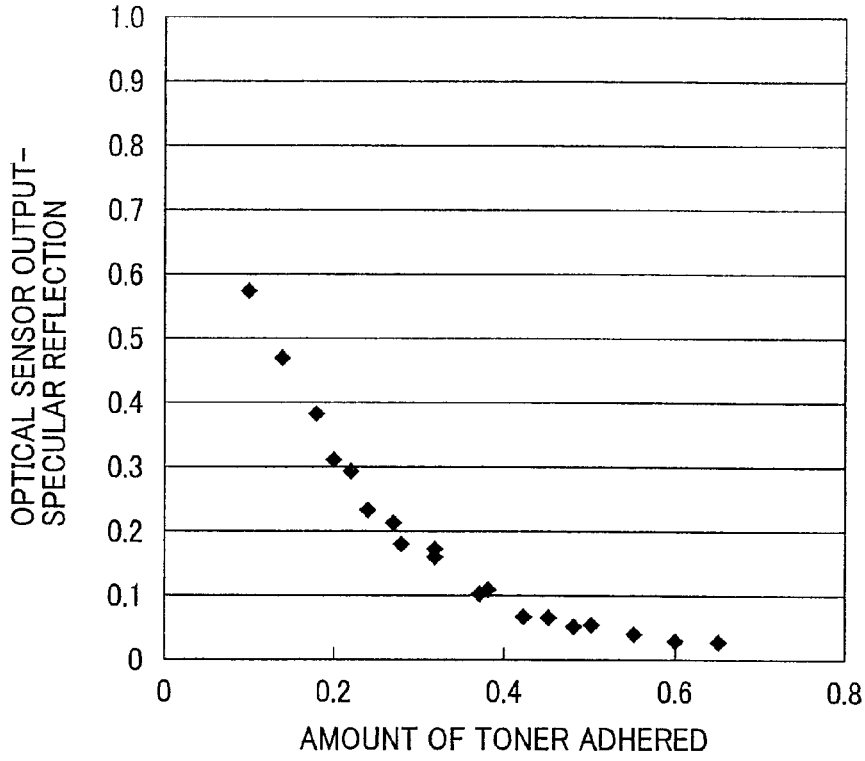
FIG. 12 is a graph illustrating the relations of an output value of a first light-receiving element of the optical sensor and an amount of toner adhered.
Figure 13:
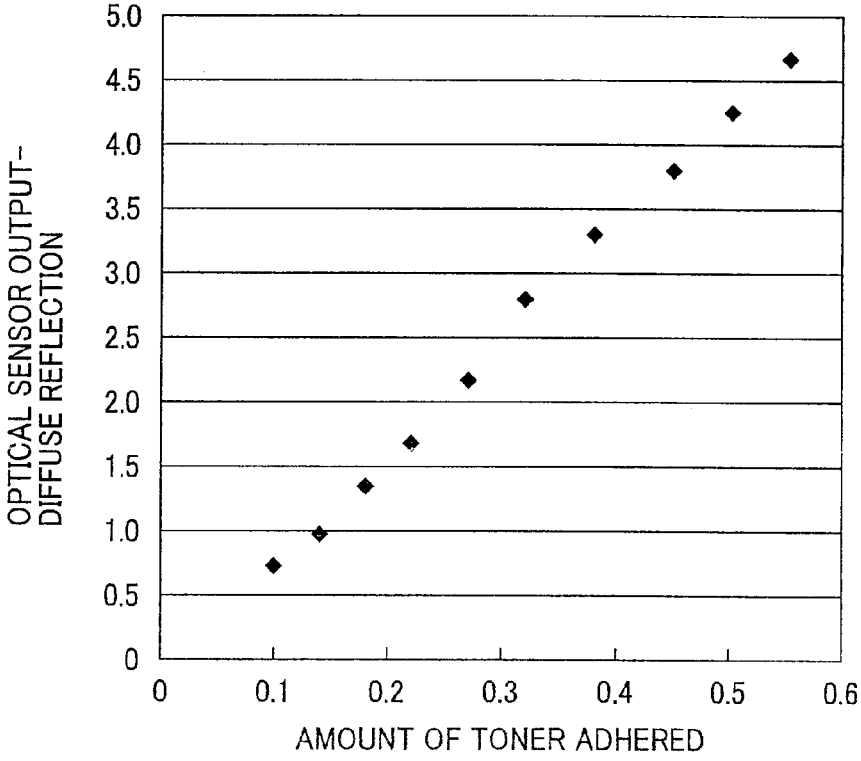
FIG. 13 is a graph illustrating the relations of an output value of a second light-receiving element of the optical sensor and the amount of toner adhered.

The RAM 202 stores therein an adhered toner amount calculation algorithm indicative of relations of the output voltage of the optical sensor 30 and corresponding amount of toner adhered. The output voltage of the first light-receiving element 32 that receives the specularly reflected light (specularly reflected light output value of the optical sensor 30) and the amount of toner adhered have relations as illustrated in FIG. 12, and the RAM 202 stores therein a specularly reflected light algorithm in which the relations of the output value of the optical sensor and the amount of toner adhered is as illustrated in FIG. 12. The output value of the second light-receiving element (diffusely reflected light output value of the optical sensor) and the amount of toner adhered have relations as illustrated in FIG. 13, and the RAM 202 stores therein a diffusely reflected light algorithm in which the relations of the output value of the optical sensor and the amount of toner adhered is as illustrated in FIG. 13.

From the output voltage of the first light-receiving element 32 obtained when detecting the toner patches in K color with the crosstalk voltage removed and the specularly reflected light algorithm, the amount of toner adhered for the toner patches of gradation patterns in K color is calculated. From the output voltages of the respective second light-receiving elements 33 obtained when detecting the toner patches in Y, M, and C colors with the crosstalk voltages removed and the diffusely reflected light algorithm, the amount of toner adhered for each toner patch of gradation patterns in Y, M, and C colors is calculated.

Consequently, in the present embodiment, the fact that the amount of toner adhered is calculated from the output voltage with the crosstalk voltage removed allows highly accurate adhered amount to be calculated.

After the adhered amount of each toner patch of gradation patterns in respective colors is calculated, based on the toner patches of gradation patterns in respective colors, image forming condition for each color is adjusted (S15).

A plurality of toner patches of the respective gradation patterns (Sy, m, c, and k) in Y, M, C, and K colors is developed in different combinations of drum potential and developing bias, and the amount of toner adhered per unit area (image density) is gradually increased. The amount of toner adhered and the developing potential that is the difference between the drum potential and the developing bias correlate with each other, so that their relations appear as a nearly straight line graph on a two dimensional coordinate system.

The control unit 200 calculates a function ($y=ax+b$) indicative of the straight line graph, based on the results of the detected amount of toner adhered on each toner patches and the developing potentials used for forming the respective toner patch images, by regression analysis. An appropriate developing bias is then calculated by substituting the function thus obtained with a target value of the image density, and is stored in the RAM 202 as corrected developing bias values for Y, M, C, and K colors.

The RAM 202 stores therein an image forming condition data table in which a few dozens of developing bias values are associated in advance with individually corresponding appropriate drum potentials. The control unit 200 selects a developing bias value closest to the corrected developing bias value for each of the image forming units 1Y, M, C, and K from the image forming condition table and specifies a drum potential associated therewith. The specified drum potentials are stored in the RAM 202 as corrected drum potentials for Y, M, C, and K colors. When storing all of the corrected developing bias values and the corrected drum potentials in the RAM 202 is finished, the data of developing bias values for Y, M, C, and K colors are corrected to equivalent values to the corresponding corrected developing bias values and are each stored again in the RAM. The data of the drum potentials for Y, M, C, and K colors are stored again to be corrected to equivalent values to the corresponding corrected drum potentials. Such corrections correct the image forming conditions for forming images such that the respective toner images of desired image density can be formed.

While it has been explained that the crosstalk voltage is detected when the supply current If is changed, the crosstalk voltage may be detected every time the image quality adjustment control is carried out. In the present embodiment, although the optical sensor 30 is provided facing the intermediate transfer belt 7, the optical sensor 30 may be provided facing the surface of the photosensitive element. Furthermore, the optical sensor 30 may be provided facing the recording paper.

As illustrated in FIG. 9, because the value of crosstalk voltage differs depending on the optical sensor, when the optical sensor is replaced, the crosstalk voltage is detected and the detected crosstalk voltage is stored in the RAM 202.

While the optical sensor 30 receives reflected light of both specularly reflected light and diffusely reflected light, the present invention is also applicable to an optical sensor that receives either one of the light, or to an optical sensor provided with two or more light-receiving elements. Furthermore, the present invention is applicable to optical sensors that are structured to obtain various characteristics of light from the reflected light, for example, to optical sensors that use spectroscopic characteristics such as P-wave and S-wave, etc.

The image forming apparatus according to the present embodiment has the optical sensor provided with the light-emitting element that is a light-emitting unit and the light-receiving element that is a light-receiving unit and receives the light radiated from the light-emitting element to a detection target and reflected therefrom, and outputs an output value in response to the light. The control unit 200 that is a correcting unit corrects the output value of the light-receiving element when receiving the light reflected from the detection target based on the so-called crosstalk that is the output value of the light-receiving element obtained by irradiating the detection area with light without any light reflective objects being present in the detection area. Consequently, the output value of the optical sensor is corrected to the output value with crosstalk voltage removed and the detection target can be highly accurately detected.

More specifically, the control unit 200 subtracts the crosstalk voltage from the output value of the light-receiving element when receiving the light reflected from the detection target to remove the crosstalk voltage thereof.

In the present embodiment, the light absorber 131 that is a non-reflective object and is movable between the detection area and the non-detection area of the optical sensor 30 is provided. Accordingly, when detecting the crosstalk voltage, moving the light absorber 131 in the detection area can make the condition where no light reflective objects are present in the detection area of the optical sensor. Radiating the light towards the light absorber 131 allows the crosstalk voltage to be detected. Meanwhile, when detecting the detection target, moving the light absorber 131 to the non-detection area allows the detection target to be detected.

Providing the RAM 202 that is a non-volatile memory to store therein the crosstalk voltage makes it unnecessary to detect the crosstalk voltage every time the detection target is detected. This also makes it unnecessary to detect the crosstalk voltage every time the power to the apparatus body is turned on.

Detecting the crosstalk voltage and updating the crosstalk voltage stored in the RAM with the detected crosstalk voltage at a predetermined timing allows it to respond to the fluctuation of crosstalk voltage, making a highly accurate detection possible.

When the supply current that is the input value to the light-emitting element is changed, the crosstalk voltage is detected and the crosstalk voltage stored in the RAM is updated to the detected crosstalk voltage. Consequently, the fluctuation of crosstalk voltage due to the change of supply current can be accommodated, which allows a highly accurate detection to be carried out even after the supply current is changed.

The fact that the optical sensor thus explained is used makes it possible to detect the amount of toner adhered highly accurately, allowing a highly accurate image quality adjustment to be made.

As exemplified in the second embodiment, the optical sensor is movably supported such that the detection area of the optical sensor is moved between the surface of the image carrier and the area where no light reflective objects are present. Accordingly, moving the optical sensor to the position at which the light radiating area of the light-emitting element comes to the area where no light reflective objects are present allows the crosstalk voltage to be detected. Moving the optical sensor to the position at which the light radiating area of the light-emitting element of the optical sensor faces the surface of the image carrier allows the toner image on the surface of the image carrier to be detected.

When the optical sensor 30 is replaced, detecting the crosstalk voltage and storing it in the RAM make it possible to correct the output value of the light-receiving element with the crosstalk voltage corresponding to the replaced optical sensor.

When the crosstalk voltage detected falls outside the predetermined range, determining it as a fault of the optical sensor and notifying the user of the fault, make it possible to prompt the user to replace the optical sensor.

According to the present invention, based on the output value of the light-receiving unit obtained by radiating light while no light reflective objects are present in the detection area of the optical sensor, correcting the output value of the light-receiving unit when receiving the light reflected from the detection target makes it possible to obtain the output value with the crosstalk component removed. More specifically, the output value of the light-receiving unit obtained by radiating light without any light reflective objects being present in the detection area is of a component other than the light reflected from the detection target, in other words, the crosstalk component of the optical sensor. Accordingly, the subtraction of the output value of the light-receiving unit obtained by radiating the light without any light reflective objects being present in the detection area of the optical sensor from the output value of the light-receiving unit when receiving the light reflected from the detection target allows the noise from the crosstalk to be removed substantially. Consequently, the detection target can be detected highly accurately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. An optical sensor comprising:

a light-emitting unit;

a light-receiving unit that receives light radiated from the light-emitting unit and reflected from a detection target and that outputs an output value in response to the light received; and a correcting unit that corrects the output value of the light-receiving unit when receiving the light reflected from the detection target based on a correction output value of the light-receiving unit obtained by causing the light-emitting unit to irradiate a detection area of the optical sensor with light without any light reflective objects being present in the detection area.

2. The optical sensor according to claim 1, wherein the correcting unit subtracts the correction output value of the light-receiving unit obtained by causing the light-emitting unit to irradiate the detection area with light without any light reflective objects being present in the detection area from the output value of the light-receiving unit when receiving the light reflected from the detection target.

3. The optical sensor according to claim 1, further comprising a non-reflective object that is movable between the detection area and a non-detection area.

4. The optical sensor according to claim 1, further comprising a non-volatile memory that stores the correction output value of the light-receiving unit obtained by causing the light-emitting unit to irradiate the detection area with light without any light reflective objects being present in the detection area.

5. The optical sensor according to claim 4, wherein an update output value of the light-receiving unit is obtained by causing the light-emitting unit to irradiate the detection area with light without any light reflective objects being present in the detection area at a predetermined timing, and the correction output value stored in the non-volatile memory is updated to the update output value thus obtained.

6. The optical sensor according to claim 5, wherein the predetermined timing is a timing when a supply current to the light-emitting unit is changed.

7. An image forming apparatus comprising:

an image carrier that supports a toner image on a surface thereof;

an optical sensor that detects light reflected from the toner image; and an image quality adjustment control unit that forms an image quality adjustment toner image on the surface of the image carrier and carries out image quality adjustment control based on an output value of the optical sensor when receiving the light reflected from the image quality adjustment toner image, wherein the optical sensor comprising:

a light-emitting unit;

a light-receiving unit that receives light radiated from the light-emitting unit and reflected from a detection target and that outputs an output value in response to the light received; and a correcting unit that corrects the output value of the light-receiving unit when receiving the light reflected from the detection target based on a correction output value of the light-receiving unit obtained by causing the light-emitting unit to irradiate a detection area of the optical sensor with light without any light reflective objects being present in the detection area.

8. The image forming apparatus according to claim 7, wherein the optical sensor is provided in plurality.

9. The image forming apparatus according to claim 7, wherein a fault of the optical sensor is determined and a user is notified of the fault when the correction output value of the light-receiving unit obtained by causing the light-emitting unit to irradiate the detection area with light without any light reflective objects being present in the detection area falls outside a predetermined range.

10. An image forming apparatus comprising:

an image carrier that supports a toner image on a surface thereof;

an optical sensor including a light-emitting unit and a light-receiving unit, the light receiving unit receives light radiated from the light-emitting unit and reflected from the toner image on the surface of the image carrier and that outputs an output value in response to the light; and an image quality adjustment control unit that forms an image quality adjustment toner image on the surface of the image carrier and carries out image quality adjustment control based on a toner adjustment output value of the light-receiving unit when receiving the light reflected from the image quality adjustment toner image, wherein the image quality adjustment control unit corrects the toner adjustment output value of the light-receiving unit obtained when receiving light reflected from the image quality adjustment toner image, based on a correction output value of the light-receiving unit obtained by causing the light-emitting unit to irradiate a detection area of the optical sensor with light without any light reflective objects being present in the detection area, and carries out the image quality adjustment control based on a corrected toner adjustment output value.

11. The image forming apparatus according to claim 10, wherein the optical sensor is movably supported such that the detection area of the optical sensor moves between the surface of the image carrier and an area where no light reflective objects are present.

12. The image forming apparatus according to claim 10, further comprising a non-reflective object that is movable between the detection area and a non-detection area of the optical sensor.

13. The image forming apparatus according to claim 10, further comprising:

a non-volatile memory that stores the correction output value of the light-receiving unit obtained by causing the light-emitting unit to irradiate the detection area with light without any light reflective objects being present in the detection area; and a light emitting amount adjustment unit that adjusts light emitting amount of the light-emitting unit by changing a value of current supplied to the light-emitting unit with the output value of the light-receiving unit being referred to such that the output value of the light-receiving unit when receiving the light reflected from the image carrier falls within a predetermined range, wherein the correction output value stored in the non-volatile memory is updated to an update output value of the light-receiving unit obtained by causing the light-emitting unit to irradiate the detection area with light without any light reflective objects being present in the detection area when the value of current is changed.

14. The image forming apparatus according to claim 10, wherein a new correction output value of the light-receiving unit is obtained by causing the light-emitting unit to irradiate the detection area with light without any light reflective objects being present in the detection area when the optical sensor is replaced.

15. The image forming apparatus according to claim 10, wherein a fault of the optical sensor is determined and a user is notified of the fault when the correction output value of the light-receiving unit obtained by causing the light-emitting unit to irradiate the detection area with light without any light reflective objects being present in the detection area falls outside a predetermined range.

* * * * *